United States Patent [19]

Hestrom

[11] Patent Number: 4,970,961

[45] Date of Patent: Nov. 20, 1990

[54] GOODS TRANSPORTER

[76] Inventor: Ture Hestrom, Enskiftesvägen 68, 145 60 Norsborg, Sweden

[21] Appl. No.: 236,932

[22] Filed: Aug. 26, 1988

[51] Int. Cl.[5] ..... B61B 3/00

[52] U.S. Cl. ..... 104/93; 105/153

[58] Field of Search ..... 105/153, 148, 150; 104/89, 93, 190, 189, 118, 288, 165, 168, 164; 16/87 R, 94 R, 102, 105, 107; 198/861.1, 861.2

[56] References Cited

U.S. PATENT DOCUMENTS

| | | | |
|---|---|---|---|
| 3,429,280 | 2/1969 | Dashew et al. | 105/153 X |
| 4,545,303 | 10/1985 | Fujita et al. | 104/93 |
| 4,602,567 | 7/1986 | Hedstrom | 105/153 |
| 4,781,119 | 11/1988 | Davis | 104/93 |

*Primary Examiner*—Robert J. Oberleitner

*Attorney, Agent, or Firm*—Burns, Doane, Swecker & Mathis

[57] ABSTRACT

A good transporting arrangement (1) utilizing a goods transporting path in the form of a guide device (2) and two wheels (4,6) capable of co-acting with opposite sides of the guide device. The two wheels co-act drivingly with the guide device through a drive arrangement. The rotational speed of one driving wheel (4) is adapted independently of the rotational speed of the other driving wheel (6) by co-action of one driving wheel (4) with a first electric motor and by co-action of the other driving wheel (6) with a second electric motor.

6 Claims, 1 Drawing Sheet

Fig. 1
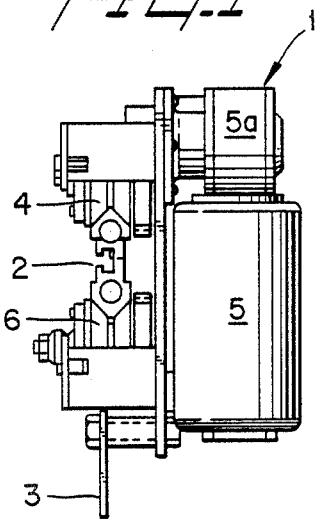
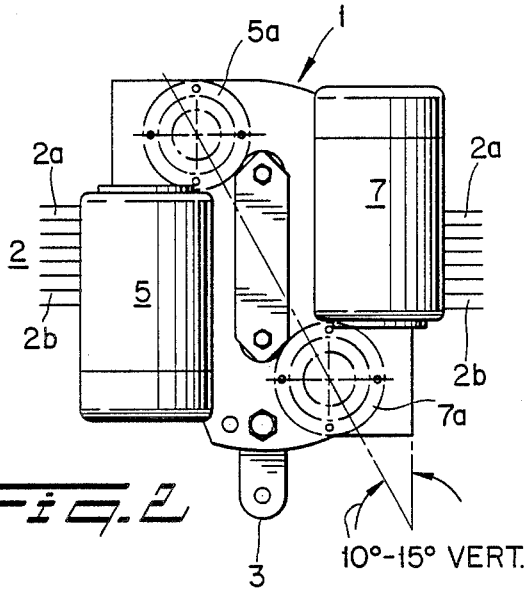
Fig. 2
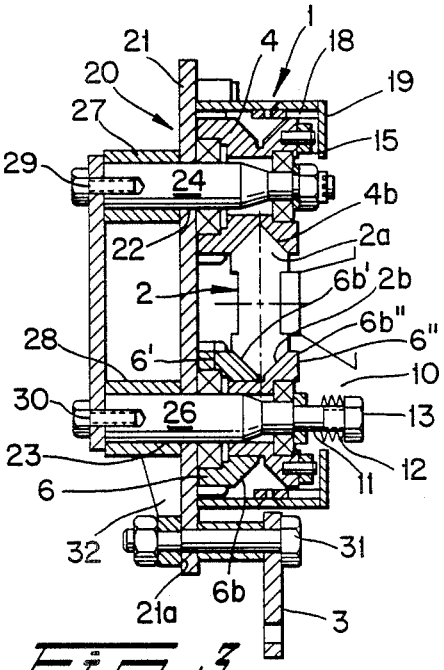
Fig. 3
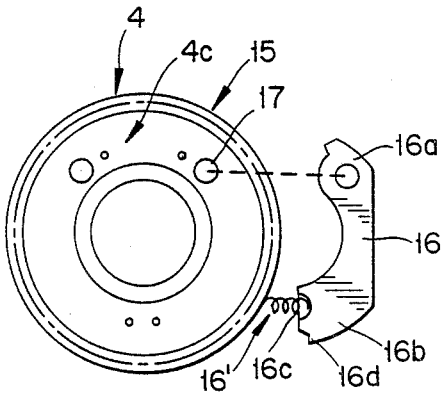
Fig. 4
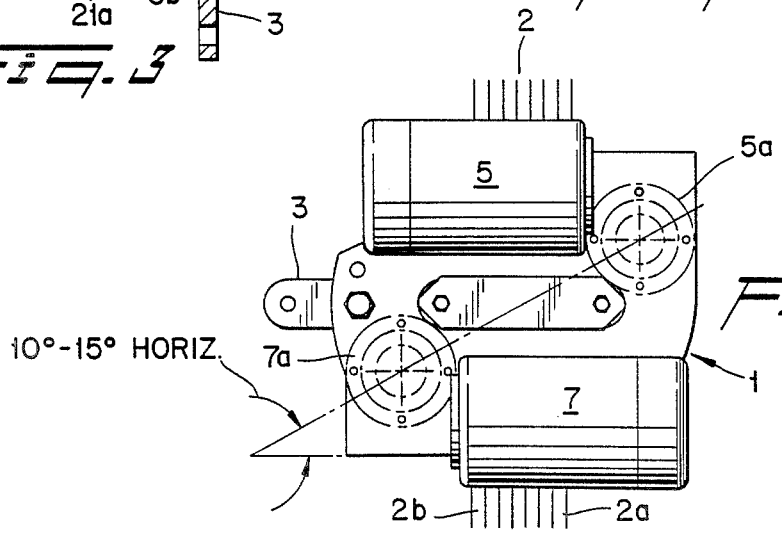
Fig. 5

GOODS TRANSPORTER

TECHNICAL FIELD

The present invention relates generally to a goods transporter or conveyor, and then particularly, although not exclusively, to a goods transporter arrangement in which a guide device is used as a conveyer path and which has two wheels which are capable of co-acting mutually on opposite sides of the guide device, and in which the two wheels are intended to co-act drivingly with the guide device through a drive means.

In the case of a guide device which extends horizontally, one of the wheels co-acts with the upper surface of the guide device, whereas the other wheel is preferably in co-action with the undersurface of said guide device.

BACKGROUND ART

A goods transporter or conveyer of the aforesaid known kind, and on which the present invention is based, is found described and illustrated in the U.S. Patent Specification 4,602,567.

Thus, this specification teaches an arrangement for conveying goods along a guide device with the aid of an electrically driven mechanism which includes two wheels for co-action with mutually opposite sides of the guide device when said device is inclined to the horizontal plane. The two wheels co-act with one another in a manner which enables the wheels to be driven synchronously by means of one single drive motor.

This is achieved with the aid of co-acting gears which ensure that the wheels rotate at mutually the same speed. When the guide device extends horizontally or substantially horizontally, the bottom wheel is not in co-acting engagement with a guide device surface, although the wheel is nevertheless driven synchronously with the upper wheel.

In the case of curved paths and guide device extensions, particularly when said paths and extensions deviate from the horizontal towards the vertical, one of the wheels will move along a longer conveyer distance on the guide device than the other wheel, which when the wheels are driven synchronously with one another means that one of said wheels will slip against the running surface on the guide device.

Furthermore the distance from one drive surface to the other and the cross-sectional configuration of the drive surfaces co-operating with the two synchronously driven wheels facing the running surfaces on the guide device are such that in a vertical conveying direction they conform with the configuration of the guide-device running surfaces in a manner such that a space formed between the drive surfaces will conform exactly to the cross-sectional profile of the guide device.

This known arrangement uses a specially constructed drive wheel, insofar as one of the wheel is divided into two wheel parts which are held together by a spring device.

The wheel parts are able to move relative to one another against a spring force, and therewith increase the distance between the drive surfaces, so that the wheel can adapt to local increases in dimensions of the guide device, such dimensional changes normally occurring at a transition from a horizontal or near horizontal extension to a vertical or near vertical extension of the conveyer part, or vice versa.

SUMMARY OF THE INVENTION

TECHNICAL PROBLEMS

When considering the prior art as described in the aforegoing, it will be seen that a technical problem is one of providing, with the aid of simple means, conditions which will ensure that neither of the two wheels will slip against the running surfaces of the guide device when the transportation of goods passes from a horizontal or near horizontal conveyor part to a vertical or near vertical conveyor path, or vice versa.

It will also be seen that a further technical problem resides in the provision of conditions which will enable the size and the power output of the motor required in the prior art arrangement to be reduced for one and the same maximum load, e.g. by eliminating power losses caused by slipping of one or both wheels against the running surfaces of the guide device when the direction of transportation of the goods changes, and particularly when said transport direction changes from a horizontal to a vertical path or vice versa.

Another technical problem resides in the provision of an arrangement for the transportation of goods which will not cause appreciable wear on the running surfaces of the guide device, particularly in the case of transport direction changes of small radius of curvature and through large angles.

A further technical problem resides in the provision of an arrangement for transporting goods in which the ability of the arrangement to hold a maximum load against a vertically extending guide device in the event of a voltage failure or some other fault is greater than the similar safety factor of the earlier known arrangement.

It will also be seen that a qualified technical problem resides in the provision of a goods transporting arrangement which comprises simple components which can be readily brought together without detracting from required high safety standards.

It will also be seen that in the case of a goods transporting arrangement of compact construction, a further technical problem resides in the provision of conditions which will enable the arrangement to be fitted with a simple, but well-functioning speed monitor which operates according to centrifugal principles and which requires only a small amount of space and will provide a safety function such as to stop the arrangement immediately the speed thereof in relation to the guide device exceeds a pre-determined value, this value being slightly greater than a nominated transporting speed.

SOLUTION

The present invention relates to a goods transporting arrangement having a goods conveying or transporting path in the form of a guide device and including two wheels which are capable of co-acting with respective opposite sides or running surfaces of the guide device and which are caused to co-act drivingly with the running surfaces of said device via a drive arrangement.

It is proposed in accordance with the invention in the case of an arrangement of this kind, which is described in more detail in the aforesaid U.S. Patent Specification 4,602,567, that the speed at which one driving wheel rotates is capable of being adapted fully independently of occurrent momentary rotational speeds of the other driving wheel, thereby ensuring separate and independent drive of the two wheels against the two mutually opposing running surfaces of the guide device.

This will ensure that no slipping, deriving from the synchronous drive, need occur between the driving surfaces of the wheels and the running surfaces of the guide device, even when the guide device is curved through a small radius of curvature and therewith presents a longer movement path to one wheel than to the other.

In this respect it is proposed in the illustrated embodiment that one driving wheel is arranged to co-act with a first electric motor and that the second driving wheel is arranged to co-act with a second electric motor.

Each of the two wheels will preferably present a known angled drive surface which faces towards a respective angled running surface on the guide device, and will have means for faltering the space, and to some extent the distance, between the opposing, normally parallel angled drive surfaces, for instance to adapt to dimensional changes occurring between two opposing, angled running surfaces on the guide device.

In accordance with one embodiment of the invention, said means comprises a wheel which is divided perpendicularly to its axis of rotation, such as to form two mutually adjacent separate wheel parts, each having a drive surface which faces towards a respective running surface on the guide device, and in that a spring device is arranged initially to urge the wheel parts towards one another at a force greater than 1000 N.

It is proposed that the spring device is so constructed that when the transport arrangement moves in a precise vertical direction and transports a predetermined maximum load, the wheel parts will be held in a mutual position such that a line between the rotational axes of the wheels forms an angle of 10–15°with the horizontal.

According to a further embodiment of the invention, a centrifugal-acting speed monitor is mounted on the outer surface of at least one driving wheel, this monitor being intended to latch rotation of the wheel and to stop and prevent further movement of the arrangement immediately the rotational speed of the wheel exceeds a pre-determined value.

According to one preferred embodiment the speed monitor comprises two arms each of which is pivotally mounted at one end thereof to the outer surface of the wheel and each of which is secured at its other, freely movable end to a spring device. The centrifugal force occurring at a predetermined rotational speed on the movable ends of the arms will urge the arms outwardly against the force of said spring device and cause the arms to strike against an edge surface on a fixed part of a frame structure.

This frame structure will preferably comprise a central plate which is provided with two holes, one for each shaft of respective driving wheels, and a sleeve which extends from the plate and the holes and which surrounds respective holes and shafts, respective shafts being held to the frame by means of a bolt.

ADVANTAGES

Those advantages primarily afforded by a goods transporting arrangement according to the present invention reside in the provision of conditions whereby the driving wheels are both urged against the drive device while being driven fully independently, so as to avoid slipping of one wheel in relation to the other wheel when the direction of transportation changes, particularly when changing from a horizontal to a vertical goods transporting path.

BRIEF DESCRIPTION OF THE DRAWING

An embodiment of the invention at present preferred and having characteristic features significant of the invention will now be described in more detail with reference to the accompanying drawing, in which FIG. 1 illustrates the arrangement in co-action with a horizontal guide device, said illustration being shown in end view and at right angles to the extension of the guide device, FIG. 2 is a side view of the arrangement illustrated in FIG. 1, FIG. 3 is a sectional end view of the arrangement as it would appear from the back side of FIG. 1, and FIG. 4 illustrates a front surface of driving wheel having mounted thereon a centrifugal-acting speed monitor, FIG. 5 illustrates a side view of the device configured for vertical movement.

DESCRIPTION OF EMBODIMENTS AT PRESENT PREFERRED

To those desiring a better understanding of the application of the present invention, reference is made to the earlier mentioned U.S. Patent Specification 4,602,567.

FIGS. 1, 2 and 3 of the accompanying drawings illustrates a goods transporting or conveying arrangement 1 which is capable of being displaced along a horizontal guide device 2.

In the case of the illustrated embodiment, the guide device 2 is shown to extend solely in a horizontal direction, although it will be understood that the inventive arrangement will follow the guide device irrespective of the direction in which it extends. Thus, the guide device may extend in other directions, such as vertically, by incorporating appropriate curves in the guide device.

The goods transported by the arrangement are intended to be loaded on and hung on support plate 3.

The goods transporting arrangement 1 comprises two separate driven wheels 4, 6 which are capable of co-acting with respective opposing side *2a*, *2b*, or running surfaces on the guide device, the driving surfaces of the two wheels being intended for driving co-action with the running surfaces of said guide device.

The one driving wheel 4 co-acts with a first electric motor 5, whereas the other driving wheel 6 co-acts with a second electric motor 7. In accordance with the invention, at least one of the motors 5, 7, in the illustrated embodiment both motors, will co-act with its respective driving wheel 4, 6 via a gear arrangement *5a* and *7a* respectively.

By operating the two electric motors 5, 7 separately, it is possible to adapt the rotational speed of one driving wheel 4 completely independently of the prevailing rotational speed of the other driving wheel 6 and its electric motor 7 with associated gear arrangement *7a*.

This individual drive of the two electric motors will reduce to a minimum any slipping that might occur between the driving wheel 4 and the running surface *2a* of the guide device and between the driving wheel 6 and the running surface *2b* of said device, even when the guide 2 extends in a curved path of small radius of curvature, and particularly when the curve extends from a vertical or near vertical path to a horizontal or near horizontal path or vice versa.

Each of the two wheels 4, 6 presents an angled drive surface 4b, 6b which extends convergently towards the centre of the wheel and which faces a respective outwardly divergent, angled running surface 2a, 2b on the guide device.

Means are also provided for changing the distance, preferably the space extension, between the angled drive surfaces 4b, 6b, such that said space will constantly adjust to dimensional changes between the two mutually opposing, angled, normally parallel running surfaces 2a, 2b on the guide device. Such dimensional changes are particularly occurrent in the presence of the aforesaid bends or curves.

In accordance with the present invention said means is provided by dividing at least one of said wheels 4, 6, ( in the exemplifying embodiment solely the wheel 6), perpendicularly to its axis of rotation, such as to form two mutually adjacent wheel parts 6' and 6'', each having a drive surface 6b' and 6b'' which faces towards the respective two angled running surfaces 2b on the guide device.

The arrangement also includes a spring device 10 which is intended to urge the wheel parts 6' and 6'' initially towards one another at a horizontally directed force exceeding 1000N, preferably a force of about 1500N, so as to generate friction between the wheel 4 and the running surface 2a, and particularly between the wheel 6 and the running surface 2b, when the arrangement moves in a horizontal transporting direction.

It should be mentioned in this connection that in the case of a horizontally extending guide device it is not necessary for the wheel 6 to abut the bottom running surface 2b, and the wheel may be spaced from said running surface.

In this case the wheel 6 will idle. The power required for transporting goods along a horizontal path, however, is effectively produced solely by means of the motor 5 acting on the wheel 4.

If the direction of the guide device changes slightly, the wheel 6 will come into abutment with the bottom running surface 2b of the guide device.

Notwithstanding this, however, it is proposed that the spring device comprises a first set of springs 11 which require the application of a force of 12000–15000N in order to be compressed, and that a second set of springs 12 require a force slightly above 1000 N in order to be compressed.

In the case of the illustrated embodiment, the spring device 10 includes a nut 13 with which the springs 11 and 12 of the spring device are tensioned to such an extent such that the springs 12 will become fully compressed and therewith ensure that the wheels 4 and 6 will co-act with the guide device 2 at a tension force of 1000N when the carriage moves on the horizontal or almost horizontal path and in the absence of further influential forces, but that when passing regions of greater distance between the parallel surfaces 26a and 2b, the wheel parts 6', 6'' will exert onto the guide device 2 a force in the order of magnitude of 12000N.

The spring device 10 is also constructed so that in the case of vertical movement and a pre-determined maximum load, the wheel parts will be held in a position such that a line between the rotational axes of the wheels will form an angle of 10–15° with the horizontal.

When the wheels 4 and 6 are driven separately, it is at times suitable to ensure that satisfactory friction is obtained between the wheel 6 and the running surface 2b when the guide device extends horizontally, so that the wheel 6 will not rotate free from load. This satisfactory friction is obtained automatically immediately as the guide device deviates from a horizontal direction.

In accordance with the invention a speed monitor 15 which operates in accordance with centrifugal principles is mounted on the outer surface of at least one wheel, in the exemplifying embodiment on the outer surfaces of both wheels 4, 6.

FIG. 4 illustrates one such speed monitor 15 mounted on the outer surface 4c of the wheel 4. The monitor comprises two arms 16 (one arm is active in a first directional rotation and the other arm active in the opposite direction of rotation), of which arms one is shown in an exploded view in FIG. 4. One end 16a of the illustrated arm 16 is pivotally mounted to the outer surface 4c of the wheel 4 by means of a pivot pin 17, and the other, freely movable end 16b of said arm is held firmly to an adjacent arm of a spring arrangement 16' which is illustrated schematically in the Figure and which is mounted in a recess 16c in the arm 16.

The two movable ends (16b) are urged outwardly by the centrifugal forces generated at a pre-determined high rotational speed against the action of the spring force, and engage, through the medium of a hook or notch 16b, an edge surface 18 on a fixed part 19 of a frame structure 20.

The frame structure 20 has a central plate 21 which is provided with two holes 22, 23, one hole for each shaft 24, 26 of respective wheels 4, 6 and a sleeve 27, 28 which extends from the plate 21 and the wheels 4, 6 and which surrounds said holes 22, 23 and said shaft 24, 26.

Respectively shafts 24, 26 are firmly held to the frame structure 20 by means of a respective bolt 29, 30.

The lowermost part of the frame structure 20 co-acts with the remainder of the frame via a bolt 31, the lower part 21a of the central plate 21 being stiffened with a web 32.

The aforedescribed construction affords the advantage that when the arrangement co-acts with a vertically extending guide and the arm 31 is subjected to maximum load, one motor 5 with associated gear arrangement 5a can be disconnected without the arrangement falling down the guide device.

It will be understood that the described exemplified embodiment is not restrictive of the invention and that modifications can be made within the scope of the accompanying claims.

I claim:

1. A goods transporting arrangement comprising:

a guide device forming a transport path;

two driving wheels which simultaneously coact drivingly with opposite sides of said guide device means for driving the driving wheels whereby the rotational speed of one driving wheel is independent of the rotational speed of the other driving wheel; and a spring device arranged to position said driving wheels such that a line drawn between the rotational axes of said driving wheels from a 10–15° angle from the horizontal when said goods transporting arrangement moves in a substantially vertical path and carries a predetermined maximum load.

2. A goods transporting arrangement as claimed in claim 1, further comprising:

an angled driving surface formed on each of said two driving wheels;

two angled running surfaces formed on said guide device and respectively facing said angled driving surfaces; and means for altering the distance between said angled driving surfaces to adapt to dimensional changes between two mutually opposing angled running surfaces on the guide device, said altering means includes means for dividing at least one of said driving wheels at right angles to its rotational axis in order to form two mutually adjacent wheel parts each having a driving surface facing a respective running surface on said guide device.

3. A goods transporting arrangement according to claim 1, further comprising a frame structure with a central plate provided with two holes, one for each shaft of respective wheels, and a sleeve which extends from the plate and from said wheels and which surrounds said holes and said shafts; and wherein respective shafts are held to the frame structure by means of a bolt.

4. A goods transporting arrangement comprising:

a guide device forming a transport path;

two driving wheels which simultaneously coact drivingly with opposite sides of said guide device;

means for driving the driving wheels such that the rotational speed of one driving wheel is independent of the rotational speed of the other driving wheel;

an angled driving surface formed on each of said two driving wheels;

two angled running surfaces formed on said guide device and respectively facing said angled driving surfaces;

means for altering the distance between said angled driving surfaces to adapt to dimensional changes between two mutually opposing angled running surfaces on the guide device, said altering means includes means for dividing at least one of said driving wheels at right angles to its rotational axis in order to form two mutually adjacent wheel parts each having a driving surface facing a respective running surface on said guide device; and a spring device arranged to position said driving wheels so that a line drawn between the rotational axes of the wheels forms an angle of 10–15° from the horizontal when the transporting arrangement moves in a substantially vertical path and carries a predetermined maximum load.

5. A goods transporting arrangement comprising a guide device forming a transport path;

two driving wheels which simultaneously coact drivingly with opposite sides of said guide device;

means for driving the driving wheels such that the rotational speed of one driving wheel is independent of a rotational speed of the other driving wheel;

an angled driving surface formed on each of said two driving wheels;

two angled running surfaces formed on said guide device and respectively facing said angled driving surfaces;

means for altering the distance between said angled driving surfaces to adapt to dimensional changes between two mutually opposing angled running surfaces on the guide device, said altering means includes means for dividing at least one of said driving wheels at right angles to its rotational axis in order to form two mutually adjacent wheel parts each having a driving surface facing a respective running surface on said guide device; and a speed monitor having two arms;

whereby one end of each of the two arms of the speed monitor is pivotally mounted on the outer surface of one of said driving wheels;

a spring device for holding together the freely movable ends of the two arms and;

whereby the movable ends of the two arms are urged outwardly, against the action of said spring, by the centrifugal force occurring at a predetermined rotational speed, such as to strike against an edge surface on a fixed part of the arrangement.

6. A goods transporting arrangement comprising a goods transporting path in the form of a guide device and further comprising two wheels which coact with mutually opposite sides of the guide device and are driven by respective drive means driving means, the wheels are arranged to simultaneously coact drivingly with said guide device whereby the rotational speed of one driving wheel is independent of the rotational speed of the outer driving wheel in order to minimize slipping that may occur between one driving wheel and the one running surface of the guide device or between the other driving wheel and the other running surface of the guide device, even when the guide device extends in a curve having a small radius of curvature.

* * * * *